US005223323A

United States Patent [19]

Dickerhof et al.

[11] Patent Number: 5,223,323

[45] Date of Patent: Jun. 29, 1993

[54] PROCESS FOR COATING FINISH FOILS AND ENDLESS EDGES

[75] Inventors: Karl-Heinz Dickerhof, Drensteinfurt; Joachim Roll, Münster; Wilhelm Moss, Warendorf; Thomas Schwalm, Hamm, all of Fed. Rep. of Germany

[73] Assignee: BASF Corporation, Parsippany, N.J.

[21] Appl. No.: 743,288

[22] PCT Filed: Jan. 26, 1990

[86] PCT No.: PCT/EP90/00145

§ 371 Date: Sep. 30, 1991

§ 102(e) Date: Sep. 30, 1991

[87] PCT Pub. No.: WO90/10111

PCT Pub. Date: Sep. 7, 1990

[30] Foreign Application Priority Data

Jan. 21, 1989 [DE] Fed. Rep. of Germany ..... 3905268

[51] Int. Cl.[5] ..... D06N 7/04

[52] U.S. Cl. ..... 428/143; 525/437; 525/441; 525/445; 525/446; 525/472; 525/473; 528/230; 528/232; 528/242; 528/246; 524/158; 524/442; 524/445; 524/446; 524/447; 524/449; 524/451; 524/453; 428/145; 428/147; 427/262; 427/263

[58] Field of Search ..... 525/472, 473, 437, 441, 525/445, 446; 528/230, 232, 242, 246; 524/158, 442, 445, 446, 447, 449, 451, 453; 428/143, 145, 147; 427/262, 302

[56] References Cited

U.S. PATENT DOCUMENTS

| | | | |
|---|---|---|---|
| 3,994,851 | 11/1976 | Chang | 524/598 |
| 4,102,847 | 7/1978 | Hartmann et al. | 524/509 |
| 4,156,038 | 5/1979 | Fock et al. | 427/210 |
| 4,303,581 | 12/1981 | Levine et al. | 523/412 |
| 4,532,157 | 7/1985 | Schmidt et al. | 427/262 |
| 4,708,984 | 11/1987 | Forgione et al. | 525/127 |
| 4,940,841 | 7/1990 | Dickerhof et al. | 524/510 |
| 4,942,198 | 7/1990 | Dickerhof et al. | 524/510 |

*Primary Examiner*—John Kight, III
*Assistant Examiner*—S. A. Acquah
*Attorney, Agent, or Firm*—Frank G. Werner

[57] ABSTRACT

The present invention relates to a process for coating finish foils and endless edges, wherein an acid-curing aqueous coating composition, on the basis of aminoplast resin/compound containing hydroxyl groups/self-crosslinking acrylate dispersion, is applied and baked in. The coating composition used contains 5 to 20% by weight of one or more fillers of a mean particle size from 0.015 to 10 μm, a maximum particle size of ≦40 μm and a density of ≦2.9 g/cm$^3$.

The invention also relates to the coating compositions positions used in the process and to finish foils and endless edges produced by the process, which especially have the advantage of an extremely low formaldehyde emission, particularly as a composite with a low-formaldehyde chipboard.

19 Claims, No Drawings

PROCESS FOR COATING FINISH FOILS AND ENDLESS EDGES

The present invention relates to a process for coating finish foils and endless edges, wherein an aqueous, acid-curing coating composition is applied and baked in.

Furthermore, the invention relates to the aqueous, acid-curing coating compositions used in this process and to the finish foils and endless edges coated by this process, and in particular both with and without a three-dimensional pore structure.

Impregnated papers which, when pressed onto boards, represent a pretreatment in the sense of priming (priming foil) or frequently also display a decorative effect (decorative foil) have been proven in the furniture and board industries over a long time. The scarcity and rising price of real veneers have very substantially contributed to increased use of the latter foils. After pressing onto chipboard or hard fiberboard, the foils must be revarnished, since otherwise the surface effect is inadequate.

In the course of simplification of the production sequence, an improved type of impregnated papers, namely the finish foil, is gaining-increasing importance. These are impregnated plain-colored or printed paper foils which are provided with a varnish coat by the foil manufacturer.

The finish foils and endless edges (for continuous edge-coating) thus obtained are supplied as roll material to the furniture and board industries, where they are glued under the action of heat and/or pressure to substrates such as, for example, chipboard or hard fiberboard. In this way, surfaces are obtained which as a rule do not require any further varnishing and can thus be processed further "as they drop out of the press".

As the result of the development of special water-repellent pore-printing inks, finish foils are also available which have a three-dimensional pore structure and represent an excellent imitation of wood veneer (cf., for example, German Offenlegungsschrift 3,247,677, U.S. Pat. No. 3,811,915 and German Offenlegungsschrift 3,024,391). The resemblance to a natural veneer has considerably stimulated the demand for such decorative foils and varnish systems.

The varnishes used for varnishing the finish foils and endless edges in question and the coatings produced from the varnishes must meet stringent demands.

Thus, both during the coating of finish foils and endless edges, and during the further processing of the coated foils or edges, only small quantities or none at all, of organic solvents and/or formaldehyde should be emitted.

This demand for low solvent emission can be met only by aqueous coating systems. Thus, for example from the publication of the international Application WO 88/06,176, aqueous two-component coating compositions for one-sided coating of finish foils and endless edges are known, which lead to coatings having a low formaldehyde emission ($\leqq 3.5$ mg/hm$^2$, determined according to DIN 52368). With these systems, it is necessary in order to achieve the excellent properties of the resulting coating, to add to the coating compositions a self-crosslinking acrylate dispersion in very high proportions of 40 to 85% by weight, preferably even 60 to 85% by weight, each relative to the total composition of the binder component.

A further demand to be met by varnishes suitable for coating finish foils and endless edges is that they can be applied by the varnishing machines conventional in foil manufacture and that, after a heat treatment lasting less than 60 seconds, as a rule 10 to 20 seconds, at 140° at 210° C. have cured to such an extent that they withstand without damage the press conditions applied in the manufacture of the boards or furniture parts (for example 5 to 30 seconds at 150° to 180° C. and 5 to 20 l kp/cm$^2$; more severe press conditions: up to 180 seconds at 170° to 180° C. and up to 30 kp/cm$^2$, without blocking properties and discolorations. The surfaces thus obtained should have the highest possible scratch resistance. In addition, the best possible resistance of the coatings to various reagents, for example food items such as beer, coffee and the like, as demanded in DIN 68,861, group A, is also required.

In addition, it is desirable that the varnished but not yet pressed foils do not warp or even roll up.

German Offenlegungsschrift 2,316,158 has disclosed aqueous acid-curing two-component coating compositions based on etherified aminoplast resin and polyester resins, which are also used for coating foils for the furniture industry. The two-component coating compositions described therein are distinguished by rapid curing as well as high hardness, scratch resistance and stackability of the resulting coating, but have the considerable disadvantage of a high formaldehyde emission by finish foils and endless edges coated with these varnishes. In line with the increasingly strict statutory conditions with respect to the formaldehyde emission of finish foils used in the furniture industry, however, there is a great demand for finish foils having a lower formaldehyde emission.

The present invention was thus based on the object of providing a process for coating finish foils and endless edges, in which the resulting coated foils have the lowest possible formaldehyde emission. Thus, the formaldehyde emission of the coated finish foil or endless edge should, individually and also in combination with a low-formaldehyde chipboard (emission class E1), not exceed a value of 3.5 mg/h m$^2$, determined according to DIN 52 368.

Moreover, for applicability of the process in practice, it is necessary that the equipment already available to the foil manufacturer can be used for carrying out the process and that the finish foils and endless edges obtained meet the abovementioned requirements. This means in particular that the varnishes used in the process can be applied by the conventional varnishing machines and cure rapidly, and that the resulting surfaces show the highest possible scratch resistance and resistance to, for example, water, mustard and coffee solution (DIN 68 861).

Surprisingly, this object is achieved by a process for coating finish foils and endless edges, wherein I) an aqueous coating composition is applied which contains, as a varnish component I,
   - A) 15 to 55% by weight, preferably 30 to 45% by weight, of one or more water-thinnable melamine resins,
   - B) 0 to 30% by weight, preferably 0 to 15% by weight, of one or more water-thinnable urea resins,
   - C) 5 to 55% by weight, preferably 20 to 40% by weight of one or more polyols, D) 0 to 15% by weight, preferably 3 to 10% by weight, of a self-crosslinking aqueous polyacrylate dispersion and E) 5 to 20% by weight, preferably 7 to 15% by weight, of one or more fillers of a mean particle size from 0.015 to 10 μm , a maximum particle size of ≦40 μm and a density of ≦2.9 g/cm$^3$, the total of the proportions by weight of the components A) to E) being always 100% by weight, and which coating composition contains, as a varnish component II, 0.5 to 30% by weight, relative to the total weight of the components A to E, of an acidic curing catalyst, the varnish components I and II preferably being mixed immediately before application, and II) the resulting wet film is baked in for a period of 8 to 50 seconds at a temperature from 90° to 200° C.

The present invention also relates to the aqueous coating composition used in the process according to the invention, and to the finish foils and endless edges which have been coated by the process according to the invention and which, if appropriate, can also have a three-dimensional pore structure.

It is surprising and was not foreseeable that it was possible by means of the process according to the invention to provide finish foils having such a low formaldehyde emission. Although it is also mentioned in German Offenlegungsschrift 2,316,158 that fillers can be added to the varnishes, this publication does not contain any indication to the effect that, by the addition of very specific fillers in precisely defined quantities to the coating compositions, the formaldehyde emission of finish foils and endless edges coated with these varnishes is drastically reduced. Rather, German Offenlegungsschrift 2,316,158 was added on the object of providing varnishes which are suitable for coating foils and which cure rapidly and nevertheless ensure an adequate service life of the varnishes.

In particular with regard to the large number of known fillers, it was surprising that it was possible, precisely by the addition of 5 to 20% by weight of fillers of a mean particle size from 0.015 to 10 μm, a maximum particle size of not more than 40 μm and a density of not more than 2.9 g/cm$^3$ to the varnishes used for coating the foils, drastically to reduce the formaldehyde emission of the coated foils, in particular in combination with chipboard. The formaldehyde emission is here significantly lower than that to be expected from a reduction of the melamine/formaldehyde resin and/or urea/formaldehyde resin by the same percentage amount. Admittedly, it is known from Japanese Published Application 57/111,367 that the formaldehyde emission of plywood and the like is reduced when adhesives based on copolymers with hydroxyl groups, aminoplast resins and fillers are used. However, even this publication does not give any indication of the influence of the fillers used on the emission of formaldehyde.

The aqueous coating composition used in the process according to the invention, containing the varnish components I (binder concentrate or dispersion) and II (curing component), will now first be explained in more detail below.

The melamine resins (component A) used in the varnish component I are generally known, as a rule etherified melamine/aldehyde reaction products, preferably melamine/formaldehyde reaction products. The water-thinnability of the melamine resins depends, apart from the degree of condensation which should be as low as possible, on the etherification component, and only the lowest members of the alkano series give water-soluble condensates. The hexamethoxymethylmelamine resins are the most important. When solubilizers are used, butanoletherified melamine resins also can be dispersed in an aqueous phase.

Suitable examples of melamine resins which will be mentioned are the water-soluble melamine resins commercially available under the trade names Cymel® 300, 301 and 303 (manufactured by Dyno Cynamide, Dusseldorf), Luwipal® 068 and 066 (manufactured by BASF AG, Ludwigshafen), Beetle® BE 3745 and BE 370 (manufactured by BIP Chemicals Ltd., Great Britain), Maprenal® MF 900, 904 and 910 (manufactured by Hoechst AG), Cibamin® (Ciba AG, Switzerland) and Resimene® 714, 745 and 747 (Monsanto). Preferably, hexamethoxymethylmelamine resins such as, for example, Cymel® 300, 301 and 303, Luwipal® 066 and Maprenal® MF 900 are used.

The melamine resins are used in a quantity from 15 to 55% by weight, preferably 30 to 45% by weight, each relative to the total of the proportions by weight of components A to E.

The water-thinable urea resins used as a component B in a quantity from 0 to 30% by weight, preferably 0 to 15% by weight, each relative to the total of the proportions by weight of components A to E are generally known water-thinnable urea/aldehyde reaction products, preferably water-thinnable urea/formaldehyde reaction products. Examples of suitable resins which may be mentioned are the plasticized or unplasticized urea/formaldehyde reaction products commercially available under the trade names Dynomin® UM 15 (manufactured by Norsk Spraengstof Industry, Norway), Resamin® VHW 3525 (manufactured by Hoechst AG) or Plastopal® (manufactured by BASF AG, Ludwigshafen).

Examples of the polyol component C suitable for crosslinking the melamine resins and formaldehyde resins are difunctional and higher-functional alcohols and/or polyesterpolyols and/or polyurethanepolyols and/or polyetherpolyols. The component C is used in a quantity from 5 to 55% by weight, preferably 20 to 40% by weight, each relative to the total of the proportions by weight of components A to E.

Examples of suitable diols and polyols which may be mentioned are ethylene glycol, diethylene glycol, propylene glycol, butylene glycol, butanediol, neopentyl glycol, triethylene glycol, hexanediol, cyclohexane-1,4-dimethanol, trimethylolpropane, ditrimethylolpropane, pentaerythritol, dipentaerythritol, trimethylolethane, glycerol, trimethylolbutane, hexanetriol, erythritol, arabitol, adonitol, xylitol, sorbitol, mannitol and dulcitol, ethoxylated and/or propoxylated derivatives of trimethylolpropane, and tris-hydroxyethyl isobyanurate. Preferably, trimethylolpropane, diethylene glycol, triethylene glycol and butanediol are used.

Examples of suitable polyesteropolyols are low-molecular, water-thinnable, linear and/or branched condensation products of adipic acid, malonic acid, phthalic acid, isophthalic acid, trimellitic anhydride, succinic acid, glutaric acid, sebacic acid, hexahydrophthalic acid, cyclohexyl-1,4-adicarboxylic acid, tetrahydrophthalic acid, maleic acid, fumaric acid, itaconic acid or citraconic acid with alcohols which contain two or more hydroxyl groups. Examples of suitable diols and polyols are the compounds listed above.

The preparation of the polyester polyols is carried out in the known manner by esterification of the components at elevated temperatures with removal of the resulting water of reaction. Preferably, an excess of the alcoholic component is used in the preparation of the polyester polyols, so that products are formed which carry hydroxyl end groups. Mixtures of the polyester polyols with triols are used as a very particularly preferred component C.

Polyetherpolyols are also suitable as the component C, such as, for example, copolymers of polyethylene oxide and polypropylene oxide up to a molecular weight of 7000, which copolymers must be water-thinnable, water-thinnable polymerization products of tetrahydrofuran as well as reaction products of polyesterpolyols with ethylene oxide or propylene oxide and addition products of alkylene oxides to diamine and polyamines, provided that these reaction products are water-thinnable.

As the component D, the varnish component I used in the process according to the invention contains 0 to 15% by weight, preferably 3 to 10% by weight, each relative to the total of the parts by weight of components A to E, of an aqueous self-crosslinking polyacrylate dispersion. As groups allowing self-crosslinking, the polyacrylate resins contain acid amide derivative groups of the general structural formula $$—CO—NOR(hu\ 1)—CH(R^2)—OR^3,$$

where $R^1$=an H atom or a $—CH(R^2)—OR^3$ grouping, $R^2$=an H atom or a $—COOR^4$ group, $R^3$=an H atom or a hydrocarbon radical containing 1 to 10 carbon atoms, preferably a methyl, ethyl, (iso)propyl or (iso)-butyl radical and $R^4$=an alkyl radical having 1 to 5 carbon atoms.

The $—CO—N(R^1)—CH(R^2)—OR^3$ groups can have been introduced into the polyacrylate molecules both via a copolymerized monomer and via a polymer-analogous reaction. Those $—CO—N(R^1)—CH(R^2)—OR^3$ groups are preferred in which $R^1$ and $R^2$ are hydrogen atoms and $R^3$ is a hydrogen atom or an alkyl radical having 1 to 4 carbon atoms, preferably methyl, ethyl, (iso)-propyl or (iso)-butyl.

The self-crosslinkable polyacrylate resins can also contain carboxyl groups in addition to the acid amide derivative groups described above. By means of a few exploratory experiments, a person skilled in the art can determine the carboxyl group content which he has to select for each case of his actual problem.

In addition to the acid amide derivative groups and carboxyl groups, the polycarylate resin can also contain further additional functional groups such as, for example, hydroxyl groups or free amide groups.

The aqueous acrylate dispersions which can be used can be prepared by generally known methods by copolymerization of (meth)acrylic acid esters, preferably methyl, ethyl, propyl or butyl (meth)acrylates, the corresponding (meth)acrylamide derivatives and, if appropriate, a corresponding quantity of monomers carrying carboxy groups and containing a polymerizable double bond, for example fumeric acid or maleic acid, preferably (meth)acrylic acid with additional use, if desired, of minor quantities of further monomers such as, for example, vinyl acetate, hydroxyalkyl (meth)acrylates, styrene, (meth)acrylamides and the like.

Preferably, dispersions having the following characteristic data are used:

Solids content: 40 to 60% by weight, preferably 40 to 50% by weight, relative to the total weight of the aqueous polyacrylate dispersion.

Mean particle diameter: 0.1 to 0.5 μm, preferably 0.1 to 0.3 μm.

Minimum film-formation temperature (MFT): 0° to 70° C., preferably from 20° to 60° C.

Viscosity: 200 to 5,000 mPas, preferably 200 to 1,000 mPas and pH value: 2 to 10, preferably greater than 7.

As a constituent essential to the invention, the varnish component I contains one or more fillers of a maximum particle size of ≦40 μm, preferably ≦20 μm, a mean particle size from 0.015 to 10 μm, preferably 0.015 to 8 μm, and a density of ≦2.9 g/cm$^3$, preferably ≦2.8 g/cm$^3$. In selecting the filler, especially when relatively large quantities of the curing component II (about ≦5% by weight of curing catalyst, relative to the total weight of the coating composition) are used, it must be ensured that no detrimental interactions of the filler with the curing catalyst occur (for example gas evolution). Preferably, fillers of a platelet-like structure are used, since these give the best results in reducing the emission of formaldehyde.

Examples of suitable fillers are various types of talc, mica and kaolin of the particle sizes and densities indicated above, as well as other aluminum- and/or magnesium-containing silicates of the particle sizes and densities indicated above. Examples of these, commercially available under the following trade names, åre the talc types "Micro Talkum IT Extra" (manufactured by Norwegian) and "Talkum Steamic OOS" (manufactured by Luzenac), aluminum silicates "China Clay Supreme" (manufacturer ECCI), "ASP 600" and Satintone (1 (manufactured by fngelhard) and also the mica types "Mikal 00180" (manufactured by Arlati) and English mica Glimmer M" (manufactured by MICA).

The indicated selection of suitable fillers results from the required properties of the coating compositions used according to the invention. If, for example, the mean particle size of the fillers used is too small, this leads to a thixotrophy of the varnishes which is excessive for use of the varnishes in practice. If the mean particle size is too large, however, the surface quality of the resulting coating no longer satisfies the stringent demands of the foil manufacturers. The density of the fillers also has a decisive influence on their stability.

These abovementioned fillers are used in a quantity from 5 to 20% by weight, preferably 7 to 15% by weight, in each case relative to the total of the proportions by weight of components A to E. If, however, glossy surfaces are to be obtained, the quantity of component E used is only 5 to 10% by weight, relative to the total of the proportions by weight of components A to E.

For correct adjustment of the appropriate processing viscosity, both the varnish components I and II can also contain liquid diluents. Suitable liquid diluents consist of at least 50% by weight, preferably 95 to 100% by weight, relative to the total of the proportions by weight of all liquid diluents, of water. In addition, organic solvents such as, for example, monohydric or polyhydric alcohols, ethers, esters and ketones, such as, for example, N-methylpyrrolidone, butanol, isopropanol, ethanol, ethyl glycol and butyl glycol and the acetates thereof, butyldiglycol, ethylene glycol dibutyl ether, ethylene glycol diethyl ether, diethylene glycol dimethyl ether, cyclohexanone, methyl ethyl ketone, acetone, isophorone, propylene glycol or mixtures thereof can also be present.

The quantity of diluent used is in general, for varnish component I, 0 to 20% by weight relative to the total weight of all the components of varnish component I. Varnish component II usually contains 30 to 80% by weight of diluent, relative to the total weight of varnish component II.

As the curing component (varnish component II), the aqueous two-component varnish used in the process according to the invention contains a water-dilutable acid, an aqueous solution thereof or an acid blocked with amines or amino alcohols or an aqueous solution thereof. The water-dilutable acids used can be phosphoric acid, maleic acid, hydrochloric acid, para-toluenesulfuric acid and derivatives thereof, naphthalenesulfonic acid and derivatives thereof as well as the corresponding reaction products of these acids with amines or aminol alcohols such as, for example, an aqueous solution of the ammonium salt of p-toluenesulfuric acid. Solutions of paratoluenesulfuric acid in acid-stable acrylate dispersions are also very particularly suitable. Preferably, crosslinkable nonionic acrylate dispersions having a solids content of 50% and a minimum film-formation temperature of 28° to 32° C. are used. If the coating compositions according to the invention are formulated as a one-component system, the sulfonic acids are used in a blocked form, for example as the ammonium salt.

Preferably, para-toluenesulfuric acid, hydrochloric acid and phosphoric acid are used, para-toluenesulfuric acid and the solutions of p-toluenesulfuric acid in acid-stable acrylate dispersions being particularly preferred. The use of solutions of para-toluenesulfuric acid in acid-stable acrylate dispersions as the curing component has the advantage that the surface properties, in particular the surface tension, are improved. In order to obtain as uniform as possible a distribution of this curing catalyst in the coating compositions, the acids or derivatives thereof are preferably used as a solution in water or in a water-thinnable solvent.

Before application, the varnish components I and II are mixed in such a ratio that, per 100 parts by weight of varnish component I consisting of components A to E (i.e. without thinner), they are 0.5 to 30 parts by weight of the pure curing component II, i.e. varnish component II without thinner. The pot life (time during which the mixture can be processed) of the mixture obtained depends, for example, on the nature and concentration of the curing component and on the processing temperature. In accordance with the requirements of the foil manufacturers, the pot lives of the mixtures are more than 24 hours. On the other hand, the varnish components I and II separately are stable for more than 2 months.

The aqueous coating compositions used according to the invention can also contain conventional auxiliaries and additives in the usual quantities, such as, for example, 0 to 10% by weight, preferably 0 to 3% by weight, of a matting agent (silica derivatives . . .), 0 to 2% by weight, preferably 0.5 to 1.0% by weight, of waxes, for example polyethylene and polypropylene waxes), 0 to 2.0% by weight, preferably 0.5 to 1.0% by weight, of an emulsifier (ethoxylated alkylphenols, ethoxylated fatty acids), 0 to 2.0% by weight, preferably 0.5 to 1.0% by weight, of an antifoam as well as 0 to 10% by weight, preferably 0 to 3% by weight, of further additives such as plasticizers (ethoxylated glycerol . . .), thixotrophic agents (polyacrylates, polyurethanes, cellulose derivatives . . .), levelling and wetting agents (sodium salts of polyacrylates . . .) and film-forming auxiliaries (phosphoric acid esters, glycols). The percent by weight data in each case relate to the overall composition of the varnish component I, i.e. including any thinner present.

The varnish components I and II are prepared in the usual manner by mixing the components. Sometimes, it is appropriate first to dissolve a component in a solvent, if it is not available in a liquid form, and to mix this solution with the other components.

The aqueous coating composition described above can also be pigmented, in which case the varnish component I then contains 0 to 40% by weight, preferably 0 to 30% by weight of pigment, each relative to the total weight of the varnish component I. The optimum pigment content in each case depends on the desired hiding power and the pigment used and can be found by a person skilled in the art by means of easily carried out routine tests.

For incorporation of the pigments, either the various pigments can be ground up together with the binder or the varnish component I is used as the dispersing medium for an aqueous pigment paste.

As the pigments, any inorganic and organic pigments can be used which are both water-wettable and not sublimable at the temperatures used, and which do not change their color shade under the process and pH conditions.

Examples of suitable pigments are titanium dioxide of the rutile type, yellow, red and black iron oxides, carbon black and phthalocyanines. The preferred pigment used is titanium dioxide.

For carrying out the process according to the invention, the varnish components I and II are mixed, and in particular, in the case of the preferably used two-components varnishes, only just before application. If, however, by appropriate selection of the curing component, the formulation as a one-component varnish is possible, the mixing can also take place at an earlier stage. The finish foils and endless edges are then varnished with this mixture, using machines specially developed for this purpose. Screen rollers or wire blades are available as varnish application devices or metering devices. The quantity of varnish applied is usually from 5 to 50 g/m$^2$ at a wet film layer thickness of 10 to 80 μm. For drying the varnish, drying tunnels with heated air, so-called convectors or radiant IR heaters or combinations of the two or hot rollers (calenders) are normally used. After drying, the paper web is bound up into a roll and supplied in this form to the furniture industry.

As soon as the mixture of the varnish component (I) and the curing component (II) has been applied and heated to a temperature of 140° to 210° C., it cures within 10 to 55 seconds, as a rule within 10 to 20 seconds, without blister formation to such an extent that the varnish surfaces thus formed withstand without damage the further process steps—in particular the more severe press conditions applied to an increasing extent—without showing blocking properties or discolorations.

The foils and endless edges produced by the process according to the invention have, in particular, the advantage that they show a very low emission of formaldehyde of less than 3.5 mg/hm$^2$. Even when bonded to chipboard, in particular chipboard of emission class E1, they show an extremely low emission of formaldehyde of ≦3.5 mg/hm$^2$ (emission always determined according to DIN 52368).

The foil surfaces obtained by the process according to the invention are also distinguished by good scratch resistance. They also show good resistance to coffee solutions (DIN 68861) and a good to satisfactory swelling behavior.

Finally, the coating compositions used in the process have short dying times, so that, even after heat treatment at 140° C. to 210° C. for a period of less than 60 seconds, as a rule 10 to 20 seconds, the foils have cured to such an extent that they withstand without damage to press conditions applied in the production of the board or furniture parts, (for example 5 to 30 seconds at 150° to 180°0 C. and 5 to 20 kp/cm$^2$) without showing blocking properties and discolorations.

The aqueous coating compositions under discussion are also suitable for coating wood substrates such as, for example, hard fiberboard, chipboard and wood materials. In many cases, it can be advantageous to precoat with a primer. If particularly absorbent substrates are to be coated, either a separate primer, for example a dispersion-based primer, is applied first or the same coating material is applied twice.

The present invention will now be explained in more detail by reference to illustrative examples. Unless expressly stated otherwise, all parts and percentage data are given by weight.

EXAMPLE 1

Initially, a varnish component I-1 is prepared as follows:

40 parts of a 100% hexamethoxymethylmelamine resin having a viscosity of 3000 mPas (measured at 21° C.), 1 part of methoxypropanol and 35 parts of a branched polyesterpolyol having an OH number of 750 mg of KOH/g and an acid number of <1 mg of KOH/g are mixed, with stirring, with 1 part of a micronized polypropylene wax (melting point 140° C.), 1 part of a nonionic emulsifier (acrylic-polyglycol ether, density 1.12 g/cm$^3$) and 11 parts of a platelet-type aluminum silicate (mean particle size 0.015 μm, maximum particle size 15 μm, density=2.6 g/cm$^3$).

4 Parts of water and 7 parts of an aqueous self-cross-linking anionic acrylate dispersion containing amide groups (mean particle size 0.25 μm, viscosity 200 mPas at 23° C., 50% solids content) are added with stirring to the mixture obtained.

5 Parts of a 40% aqueous p-toluenesulfuric acid solution (varnish component II) are added with stirring to 100 parts of the varnish component I-1 thus prepared and the coating composition I obtained is adjusted with 40 parts of water to a viscosity of 20 seconds (measured at 20 ° C. in a DIN 4 flow cup). The content of hexamethoxymethylmelamine resin in this coating composition 1 is 27.6% by weight, relative to the total formulation.

This coating composition 1 is applied by means of a wire blade to a white impregnated material (weight of the impregnated material 80 g/m$^2$) (wet film thickness 30 μm) and then dried for 20 seconds at 160° C. in a jet tunnel. The most important properties and test results of the foil A thus obtained are compiled in Table 1.

EXAMPLE 2

Analogously to Example 1, a varnish component I-2 is prepared by mixing 30 parts of a water-thinnable, elastic urea/formaldehyde resin (acid number <3 mg of KOH/g) and 20 parts of a water-thinnable, extensively methanol-etherified melamine/formaldehyde resin (solids content 80–85%. viscosity 1.6–2.4 Pas at 23° C.) with 35 parts of a water-thinnable, partially unsaturated polyester polyol (OH number 420 mg of KOH/g, acid number <5 mg of KOH/g), 6 parts of a kaolin (mean particle size 0.80 μm, maximum particle size 35 μm, density 2.6 g/cm$^3$), 2 parts of a talc (mean particle size 5 μm, maximum particle size 25 μm, density 2.8 g/cm$^3$) and 1 part of a nonionic emulsifier (acrylic-polyglycol ether, density 1.12 g/cm$^3$) with stirring. 6 parts of water are then added with stirring. 5 parts of a 40% aqueous p-toluenesulfuric acid solution are then added with stirring to 100 parts of the varnish component I-2 thus prepared and adjusted with water to a viscosity of 20 second (measured at 20° C. in DIN 4 flow cup).

This coating composition 2 is applied, analogously to Example 1, by means of a wire blade to a white impregnated material (weight=80 g/m$^2$) (wet film thickness 30 μm) and then dried for 20 seconds at 160° C. in a jet tunnel. The most important properties and test results of the foil B thus obtained are compiled in Table 1.

EXAMPLE 3

The foil A obtained in Example 1 is pressed together with a chipboard (emission class E 2, i.e. measured formaldehyde emission: 5 mg/hm$^2$) and the formaldehyde emission of the composite is investigated. The results are shown in Table 1.

COMPARISON EXAMPLE 1 (V1)

Analogously to Example 1, a varnish component I-3 is prepared, but with the difference that the filler aluminum silicate is replaced by 11 parts of water. As the varnish component II, 5 parts of 40% aqueous p-toluenesulfuric acid are added and the mixture is adjusted with 20 parts of water to a viscosity of 20 second (DIN 4 flow cup, 20° C.). The hexamethoxymethylmelamine resin content in this coating composition 3 is 32.0% by weight, relative to the total formulation. The application and drying of this coating composition 3 and the testing of the foil C obtained are carried out analogously to Example 1. The properties and test results of foil C are compiled in Table 1.

COMPARISON EXAMPLE 2 (V2)

Corresponding to Comparison Example 1, a varnish component I-4 is also prepared analogously to Example 2, but with the difference from Example 2 that the fillers talc and kaolin are replaced by 8 parts of water. The foil top coat 4 is produced from this using 5 parts of 40% p-toluenesulfuric acid solution, and applied and dried analogously to Example 2. The properties and test results of the resulting foil D are also shown in Table 1.

COMPARISON EXAMPLE 3 (V3)

The foil C obtained in Comparison Example 1 is pressed together, analogously to Example 3, with a chipboard (emission class E 2) and the formaldehyde emission of the composite is investigated. The results are shown in Table 1.

COMPARISON EXAMPLE 4 (V4)

Analogously to Example 1, a varnish component I-5 is prepared, with the difference that the filler aluminum silicate is replaced by 11 parts of barium sulfate (mean particle size 0.8 μm, density 4.4 g/cm$^3$). The coating composition 5 is prepared from this varnish component I-5 using 5 parts of 40% p-toluenesulfuric acid solution, and applied and dried analogously to Example 1. The properties and test results of the resulting foil E are shown in Table 1.

TABLE 1

| Example | 1 | 2 | 3 | V1 | V2 | V3 | V4 |
|---|---|---|---|---|---|---|---|
| Gloss (60° reflection angle) | 20% | 12% | | | | | |
| Scratch resistance[a)] | <20 | 12 | | | | | |
| Coffee test[b)] | 1-2 | 2-3 | | | | | |
| Mustard test[b)] | 1 | 1 | | | | | |
| Water column[b)] | 2 | 2-3 | | | | | |
| Formaldehyde emission according to DIN 52368 (mg/hm$^2$) of the foil | 2.3 | 3.0 | — | 3.0 | 3.8 | — | 2.7 |
| of the composite | — | — | 3.0 | — | — | 11.0 | — |

[a)]This indicates the number of double strokes with a wooden spatula under pressure until the surface is damaged.

[b)]After 16 hours action of coffee solution (DIN 68 861) or mustard or 100 cm$^3$ of water column/cm$^2$ of surface on the varnished surface, the quality of the surface is visually assessed by comparison with an unaffected surface:

0 No visible changes 1 just detectable changes in gloss or color 2 slight changes in gloss or color, the structure of the test surface is unchanged 3 pronounced markings visible, but the structure of the test surface is largely undamaged 4 pronounced markings visible, the structure of the test surface is changed 5 test surface greatly changed or destroyed The examples make it clear that, by the addition of fillers having a mean particle size of 0.015 to 10 μm, a maximum particle size of at most 40 μm and a density of at most 2.9 g/cm$^3$ to the varnishes, the formaldehyde emission of foils coated with these varnishes is drastically reduced. As a comparison of the emission values of Example 1 with those of Comparison Example 1 (V1) and of Example 2 with those of Comparison Example 2 (V2) shows, the observed reduction in the formaldehyde emission is greater than is to be expected from the same percentage reduction of the melamine/formaldehyde resin or urea/formaldehyde resin in the cured film. Thus, for example, the hexamethoxymethylmelamine resin content in the filler-containing coating composition 1 of Example 1 is 27.6% by weight, relative to the total formulation, whereas the hexamethoxymethylmelamine resin content in the filler-free coating composition 3 of analogous structure from Comparison Example 1 (V1) is 32.0% by weight, relative to the total formulation. At the same applied quantity of the two varnishes (wet film thickness 30 μm, see above), a reduction of the emission to 2.6 mg/hm$^2$ in Example 1 is therefore expected from the emission values of Comparison Example 1 (V1) (3.0 mg/hm$^2$). However, a significantly greater reduction of the formaldehyde emission of 2.3 mg/hm$^2$ was measured in Example 1.

A comparison of the emission values of Comparison Example 4 (V4) and of Example 1 impressively confirms the fact that a reduction of the formaldehyde emission of the coated foils, which is greater than is to be expected from the same percentage reduction of the melamine/formaldehyde resin or urea/formaldehyde resin, is achievable only by the use of closely defined fillers (see above).

The effect of the fillers on the formaldehyde emission is even more clear in the case of the composites of the foils with a chipboard, as shown by the comparison of the emission values of Example 3 and Comparison Example 3 (V3).

We claim:

1. A process for coating finish foils and endless edges, wherein

I) an aqueous coating composition is applied which comprises, as a varnish component I, A) 15 to 55% by weight of one or more water-thinnable melamine resins, B) 0 to 30% by weight of one or more water-thinnable urea resins, C) 5 to 55% by weight of one or more polyols, D) 0 to 15% by weight of a self-crosslinking aqueous polyacrylate dispersion and E) 5 to 20% by weight of one or more fillers of a mean particle size from 0.015 to 10 μm, a maximum particle size of ≦40 μm and a density of ≦2.9 g/cm$^3$, the total of the proportions by weight of the components A to E being always 100% by weight, and which coating composition comprises, as a varnish component II, 0.5 to 30% by weight, relative to the total weight of the components A to E, of an acidic curing catalyst, the varnish components I and II preferably being mixed immediately before application, and II) the resulting wet film is baked in for a period of 8 to 50 seconds at a temperature from 90° to 200° C.

2. A process for coating finish foils and endless edges as claimed in claim 1, wherein I) an aqueous coating composition is applied which comprises, as a varnish component I, A) 30 to 45% by weight of one or more water-thinnable melamine resins, B) 0 to 15% by weight of one or more water-thinnable urea resins, C) 20 to 40% by weight, of one or more polyols, D) 3 to 10% by weight, of a self-crosslinking aqueous polyacrylate dispersion and E) 7 to 15% by weight, of one or more fillers of a mean particle size from 0.015 to 10 μm, a maximum particle size of ≦40 μm and a density of ≦2.9 g/cm$_3$, the total of the proportions by weight of the components A to E being always 100% by weight, and which coating composition comprises, as a varnish component II, 0.5 to 30% by weight, relative to the total weight of the components A to E, of an acidic curing catalyst, the varnish components I and II preferably being mixed immediately before application, and II) the resulting wet film is baked in for a period of 8 to 50 seconds at a temperature from 90° to 200° C.

3. An aqueous coating composition, in particular for coating finish foils and endless edges, which comprises, as a varnish component (I)

A) 15 to 55% by weight of one or more water-thinnable melamine resins,

B) 0 to 30% by weight of one or more water-thinnable urea resins,

C) 5 to 55% by weight of one or more polyols,

D) 0 to 15% by weight of a self-crosslinking aqueous polyacrylate dispersion and E) 5 to 20% by weight of one or more fillers of a mean particle size from 0.015 to 10 μm, a maximum particle size of ≦40 μm and a density of ≦2.9 g/cm$^3$, the total of the proportions by weight of the components A to E being always 100% by weight, and, as a varnish component II, 0.5 to 30% by weight, relative to the total weight of components A to E, of an acidic curing catalyst, varnish components I and II preferably being mixed immediately before application.

4. An aqueous coating composition as claimed in claim 3 which comprises as a varnish component (I)

A) 15 to 55% by weight, preferably 30 to 45% by weight, of one or more water-thinnable melamine resins, B) 0 to 30% by weight, preferably 0 to 15% by weight, of one or more water-thinnable urea resins, C) 5 to 55% by weight, preferably 20 to 40% by weight, of one or more polyols.

D) 0 to 15% by weight, preferably 3 to 10% by weight, of a self-crosslinking aqueous polyacrylate dispersion and E) 5 to 20% by weight, preferably 7 to 15% by weight, of one or more fillers of a mean particle size from 0.015 to 10 μm, a maximum particle size of ≦40 μm and a density of ≦2.9 g/cm$^3$, the total of the proportions by weight of the components A to E being always 100% by weight, and, as a varnish component II, 0.5 to 30% by weight, relative to the total weight of components A to E, of an acidic curing catalyst, varnish components I and II preferably being mixed immediately before application.

5. A coating composition as claimed in claim 3 wherein fillers of a mean particle size from 0.015 to 8 μm, a maximum particle size of ≦20 μm and a density of ≦2.8 g/cm$^3$ are used as the component E.

6. A coating composition as claimed in claim 3 wherein platelet-shaped fillers are used as the component E.

7. A coating composition as claimed in claim 3 wherein types of talc, mica and/or kaolin are used as the component E.

8. A coating composition as claimed in claim 3 wherein water-thinnable, methanoletherified melamine/formaldehyde resins are used as the component A.

9. A coating composition as claimed in claim 3 wherein the varnish component II contains, as a curing catalyst, p-toluenesulfuric acid or solutions of para-toluenesulfuric acid in acid-stable acrylate dispersions.

10. A coating composition as claimed in claim 3 wherein a mixture of a triol and a polyester polyol is used as the component C.

11. A coating composition as claimed in claim 3 wherein the coating composition contains conventional auxiliaries, additives and pigments.

12. A process as claimed in claim 1, wherein fillers of a mean particle size from 0.015 to 8 μm, a maximum particle size of ≦20 μm and a density of ≦2.8 g/cm$^3$ are used as the component E.

13. A process as claimed in claim 1 wherein platelet-shaped fillers are used as the component E.

14. A process as claimed in claim 1 wherein types of talc, mica and/or kaolin are used as the component E.

15. A process as claimed in claim 1, wherein water-thinnable, methanol-etherified melamine/formaldehyde resins are used as the component A.

16. A process as claimed in claim 1 wherein the varnish component II comprises, as a curing catalyst, p-toluenesulfuric acid or solutions of para-toluenesulfuric acid in acid-stable acrylate dispersions.

17. A process as claimed in claim 1 wherein a mixture of a triol and a polyester polyol is used as the component C.

18. A process as claimed in claim 1 wherein the coating composition contains conventional auxiliaries and additives as well as, if appropriate, pigments.

19. A finish foil or endless edge, which as been coated by the process as claimed in claim 1.

* * * * *